US008899380B2

(12) United States Patent
Chard

(10) Patent No.: US 8,899,380 B2
(45) Date of Patent: Dec. 2, 2014

(54) SYSTEM FOR RESTRAINING A WORKER AT A UTILITY PLATFORM OF AN AERIAL DEVICE

(71) Applicant: Altec Industries, Inc., Birmingham, AL (US)

(72) Inventor: Joshua T. Chard, Avon, CT (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 13/682,247

(22) Filed: Nov. 20, 2012

(65) Prior Publication Data

US 2014/0138183 A1 May 22, 2014

(51) Int. Cl.

| | |
|---|---|
| ***E04G 5/00*** | (2006.01) |
| ***B66F 11/04*** | (2006.01) |
| ***B66F 17/00*** | (2006.01) |

(52) U.S. Cl.

CPC ..... *B66F 11/04* (2013.01); *B66F 17/006* (2013.01)

USPC ..... 182/222; 46/2.1; 46/129

(58) Field of Classification Search

USPC ..... 182/3, 46, 222, 2.1–2.4, 2.6, 4, 63.1, 182/69.4–69.6, 112, 129, 141–144, 151, 182/178.1, 223, 230; 220/1.6, 23.87, 23.89, 220/23.9, 918, 920

See application file for complete search history.

(56) References Cited

U.S. PATENT DOCUMENTS

| | | | | |
|---|---|---|---|---|
| 3,414,079 | A | 12/1968 | Wacht et al. | |
| 3,489,243 | A * | 1/1970 | Stilwell et al. | 182/46 |
| 3,605,941 | A * | 9/1971 | Edwards | 182/2.1 |
| 3,695,390 | A * | 10/1972 | Leigh | 182/129 |
| 3,917,026 | A * | 11/1975 | Hedges | 182/129 |
| 4,254,846 | A * | 3/1981 | Soave | 182/46 |
| 4,554,995 | A * | 11/1985 | Schlack | 182/129 |
| 4,763,758 | A | 8/1988 | Moody | |
| 4,883,145 | A * | 11/1989 | Deltatto | 182/2.4 |
| 6,330,931 | B1 * | 12/2001 | Baillargeon et al. | 182/18 |
| 6,470,999 | B1 | 10/2002 | Schanzle | |
| 7,182,173 | B2 * | 2/2007 | Bailey | 182/2.1 |
| 7,353,817 | B2 * | 4/2008 | Kobel | 125/12 |
| 7,416,053 | B2 * | 8/2008 | Chard et al. | 182/2.4 |
| 7,980,359 | B2 * | 7/2011 | Chard et al. | 182/2.4 |
| 8,490,746 | B2 * | 7/2013 | Cummings | 182/2.2 |
| 8,708,177 | B2 * | 4/2014 | Roberts | 220/4.02 |

(Continued)

OTHER PUBLICATIONS

Definition of 'Recess' in Action The American Heritage Dictionary of the English Language, Fourth Edition copyright ©2000 by Houghton Mifflin Company. Updated in 2009. Published by Houghton Mifflin Company. All rights reserved.*

*Primary Examiner* — Daniel Cahn

(74) *Attorney, Agent, or Firm* — Erise IP, P.A.

(57) ABSTRACT

A restraint system for restraining a worker to a platform of an aerial device comprises a restraint liner and a platform strap. The restraint liner includes four sidewalls, a floor, a lip, an interior anchor, and an exterior anchor. The floor may be coupled to one end of the four sidewalls, while the lip may be coupled to the opposing end of the four sidewalls and may extend therefrom. The interior anchor may be positioned on an interior surface of a first sidewall and operable to couple to a liner strap coupled to a worker. The exterior anchor may be positioned on an exterior surface of the first sidewall. The platform strap may be coupled to the exterior anchor and operable to couple to the platform.

10 Claims, 10 Drawing Sheets

(56) References Cited

U.S. PATENT DOCUMENTS

2002/0144862 A1* 10/2002 Engvall et al. ..... 182/18
2002/0170783 A1 11/2002 Goode
2004/0055817 A1* 3/2004 Chard et al. ..... 182/2.4
2004/0262079 A1* 12/2004 Bailey ..... 182/2.3
2006/0175127 A1 8/2006 Higgins
2008/0308350 A1* 12/2008 Chard et al. ..... 182/2.4
2010/0193286 A1 8/2010 Higgins et al.
2013/0256024 A1* 10/2013 Roberts ..... 174/5 SB

* cited by examiner

SYSTEM FOR RESTRAINING A WORKER AT A UTILITY PLATFORM OF AN AERIAL DEVICE

BACKGROUND OF THE INVENTION

1. Field of the Invention

Embodiments of the current invention relate to utility platform safety. More particularly, embodiments of the current invention relate to systems for restraining workers at a utility platform.

1. Description of the Related Art

Electric utility workers typically use an aerial device in order to access overhead electric power lines and electric power components for repair or maintenance. The aerial device is usually mounted on a truck and generally includes a boom arm with a platform connected at the boom tip. The platform includes a bucket or cherry picker in which one or more utility workers stand while performing the repair or maintenance. The platform of such a device is generally non conductive, but is not dielectrically tested and not considered as insulating. An insulated liner provides desirable electrical isolation from high voltage lines or components, but does not include metal fall restraint features therein. While metal fall restraints may provide mechanical strength needed to support the weight of a worker, the metal is electrically conductive—which is not allowed in an insulated platform. As an alternative, the platform may include an anchor, usually on the outside of the platform near the boom tip, to which the worker attaches one end of a strap. The other end of the strap may be connected to a fall arrest harness that the worker wears. One drawback to this system is that it allows the worker to fall out of the platform if the platform tips or if the worker loses his balance. Another drawback is that the system allows the worker to voluntarily climb over the side (at least the rear side) of the platform, thereby putting himself in danger of falling. Yet another drawback to the system is that the fall arrest components may allow the wearer to contact a lower level at low boom elevations.

SUMMARY OF THE INVENTION

Embodiments of the current invention solve the abovementioned problems and provide a distinct advance in the art of insulated utility platforms. More particularly, embodiments of the invention provide a system of fall restraint for use with a utility platform with an insulated liner.

One embodiment of the current invention may provide a restraint liner for use with a platform coupled to a boom tip that broadly comprises four sidewalls, a floor, a lip, an interior anchor, an exterior anchor, and a platform strap channel. The floor may be coupled to one end of the four sidewalls, while the lip may be coupled to the opposing end of the four sidewalls and may extend therefrom. The interior anchor may be positioned on an interior surface of a first sidewall and operable to couple to a liner strap coupled to a worker. The exterior anchor may be positioned on an exterior surface of the first sidewall and operable to couple to a platform strap coupled to the platform. The platform strap channel may protrude inward along the first sidewall and may extend upward from the exterior anchor operable to retain a portion of the platform strap.

Another embodiment of the current invention may provide a restraint system for restraining a worker to a platform of an aerial device that broadly comprises a restraint liner and a platform strap. The restraint liner includes four sidewalls, a floor, a lip, an interior anchor, and an exterior anchor. The floor may be coupled to one end of the four sidewalls, while the lip may be coupled to the opposing end of the four sidewalls and may extend therefrom. The interior anchor may be positioned on an interior surface of a first sidewall and operable to couple to a liner strap coupled to a worker. The exterior anchor may be positioned on an exterior surface of the first sidewall. The platform strap may be coupled to the exterior anchor and operable to couple to the platform.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 8:
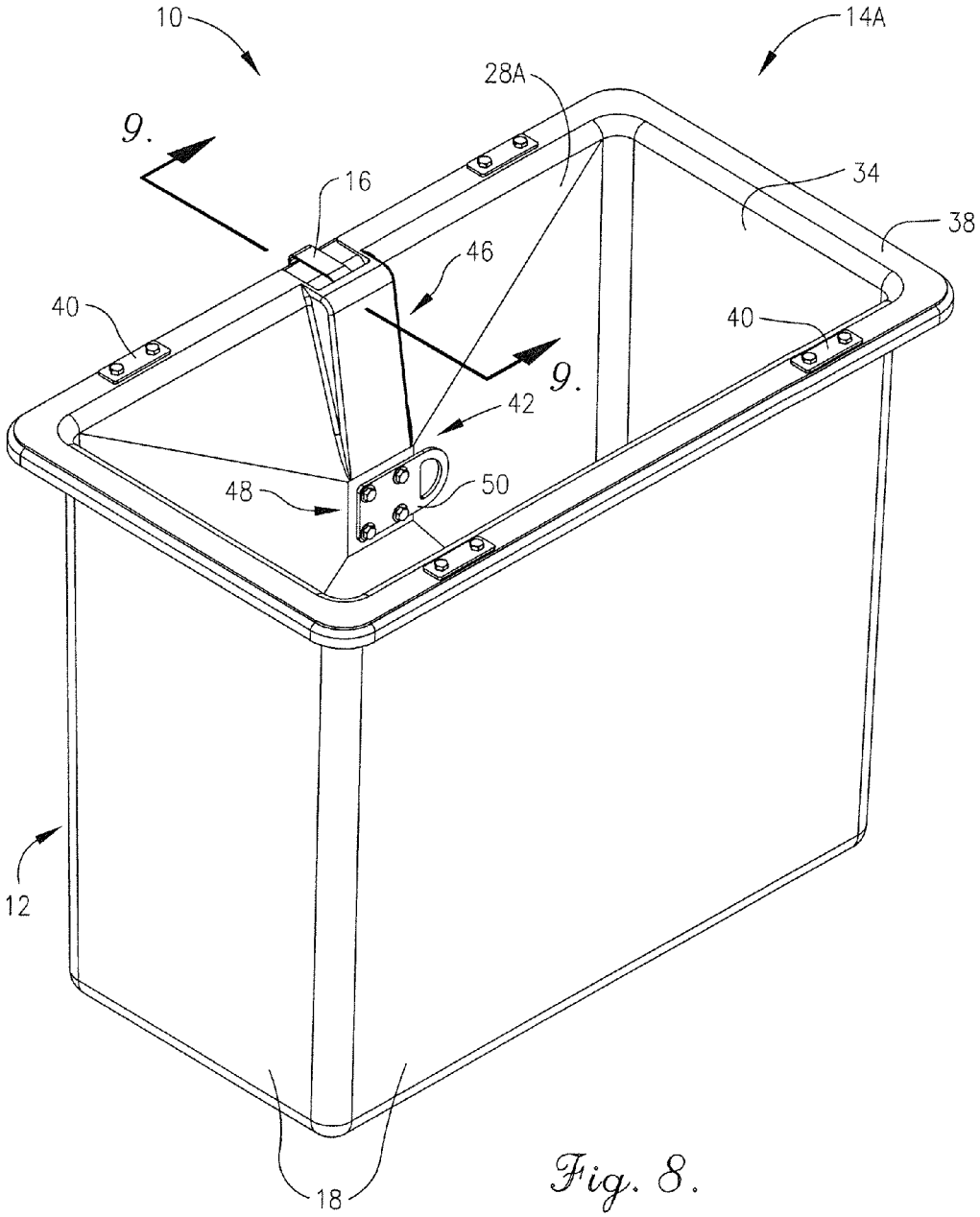
FIG. 8 is a perspective view of the restraint system, depicting a second embodiment of the restraint liner, as seen from above the front of the platform.
Figure 9:
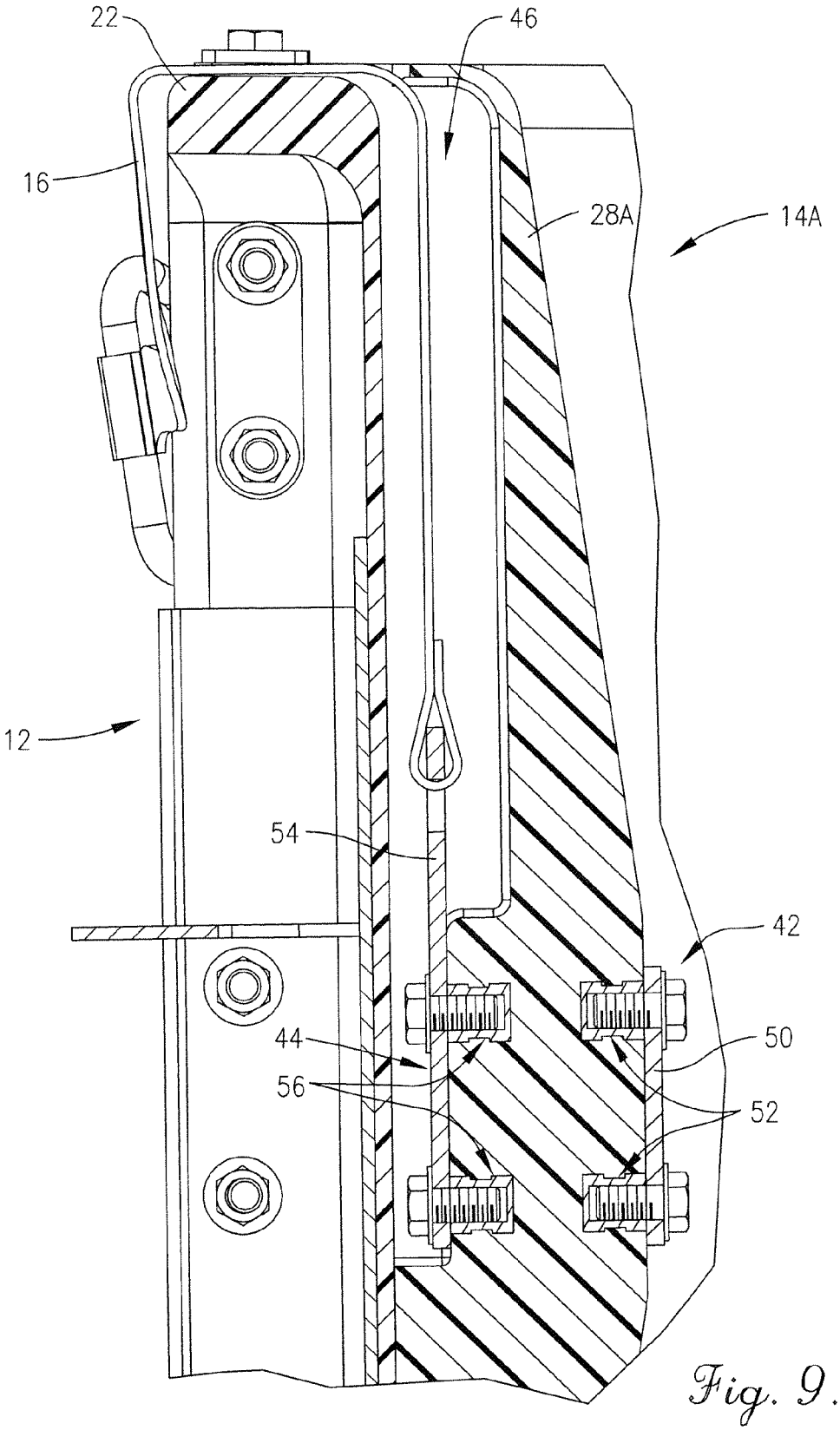
Figure 10:
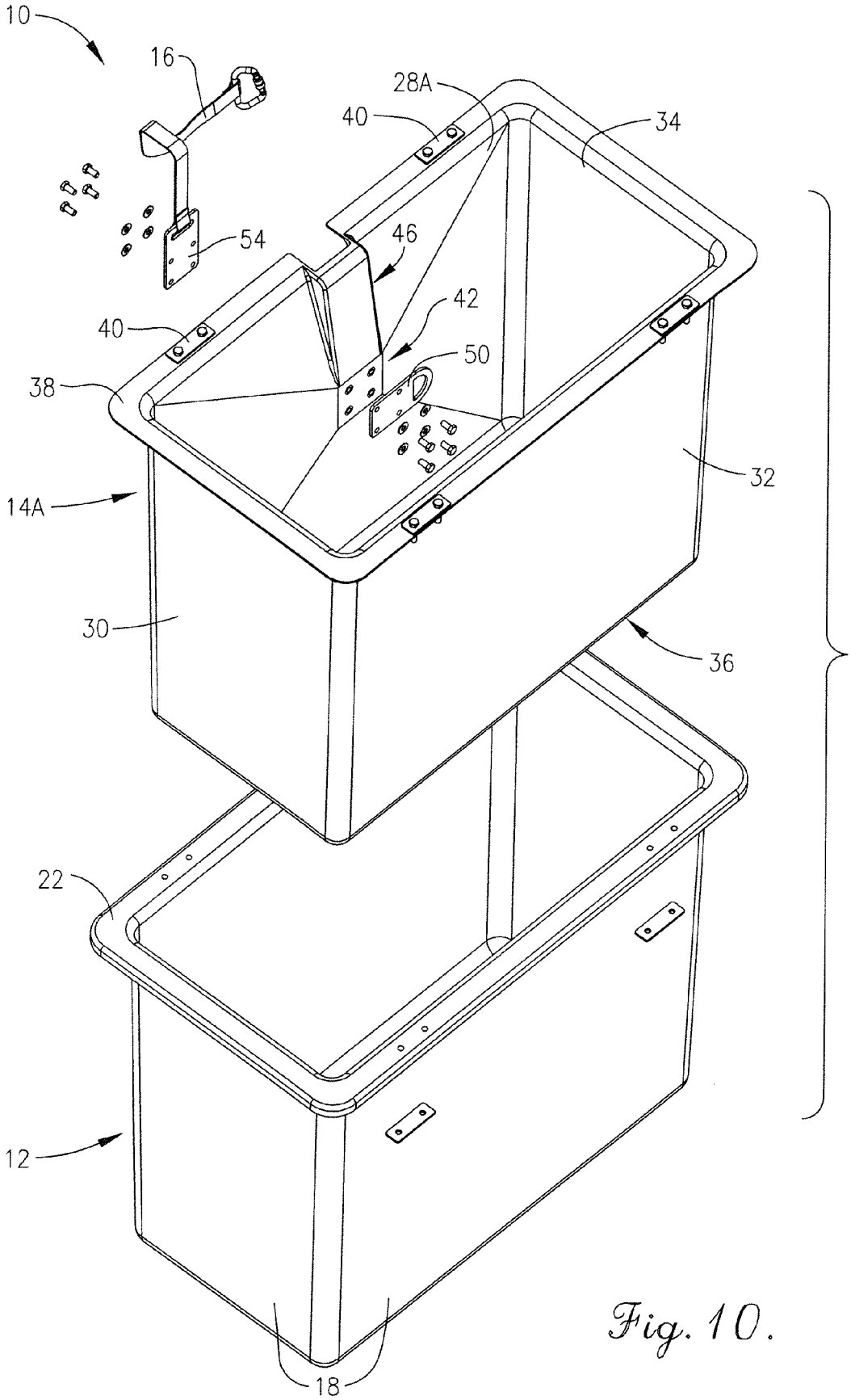

FIG. 9 is a fragmentary sectional view of the restraint system cut along the line "9-9" from FIG. 8, depicting the second embodiment of the restraint liner with a tapered thickness sidewall; and FIG. 10 is a perspective exploded view of the restraint system, depicting the second embodiment of the restraint liner separated from the platform, the exterior anchor plate coupled to the platform strap, and an interior anchor with an interior anchor plate, as seen from above the front of the platform.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

A restraint system 10, constructed in accordance with various embodiments of the current invention, for use with a platform 12 is shown in FIGS. 1-10. The restraint system 10 may broadly comprise a restraint liner 14 and a platform strap 16. In various embodiments, the restraint liner 14 is insulated. The restraint system 10 generally adapts a platform 12 that only offers fall arrest protection into a platform 12 that includes fall restraint protection.

The platform 12 is typically a "bucket" or "cherry picker" that couples to the tip of a boom that is integrated with a truck mounted aerial device. The platform 12 may include four bucket sidewalls 18 and a bucket floor 20 that form an enlarged cavity in which at least one worker, typically an electrical utility worker, can stand. The platform 12 may also include a bucket lip 22. There may be enough space within the platform 12 for the worker to walk around, as well as store tools or supplies. Furthermore, there may be controls on the tip of the boom that enable the worker to position and orient the platform 12 such as by raising, lowering, or rotating the platform 12.

The four bucket sidewalls 18 may be successively coupled to one another to form a cylinder with a roughly rectangular cross section. Thus, two of the opposing bucket sidewalls 18 may have a greater width than the other two opposing bucket sidewalls 18. In other embodiments, the four bucket sidewalls 18 may form a cylinder with a roughly square cross section. The bucket floor 20 may be coupled to one unconnected end of the four bucket sidewalls 18. The bucket lip 22 may be coupled to the opposing unconnected end of the four bucket sidewalls 18 and may form a flange that protrudes outward therefrom. Although the dimensions of the platform 12 may vary widely, an exemplary platform 12 for one or two workers may have an opening of approximately 24 inches by approximately 48 inches and may have a height of approximately 42 inches.

The platform 12 may further include a pair of ribs 24 to which the tip of the boom (not shown in the figures) attaches. The ribs 24 may be vertically oriented, elongated, spaced apart, and may protrude from the exterior surface of one of the wider bucket sidewalls 18. In addition, the platform 12 may include a platform anchor 26 positioned either on one of the ribs 24 or in proximity to the ribs 24.

Figure 1:
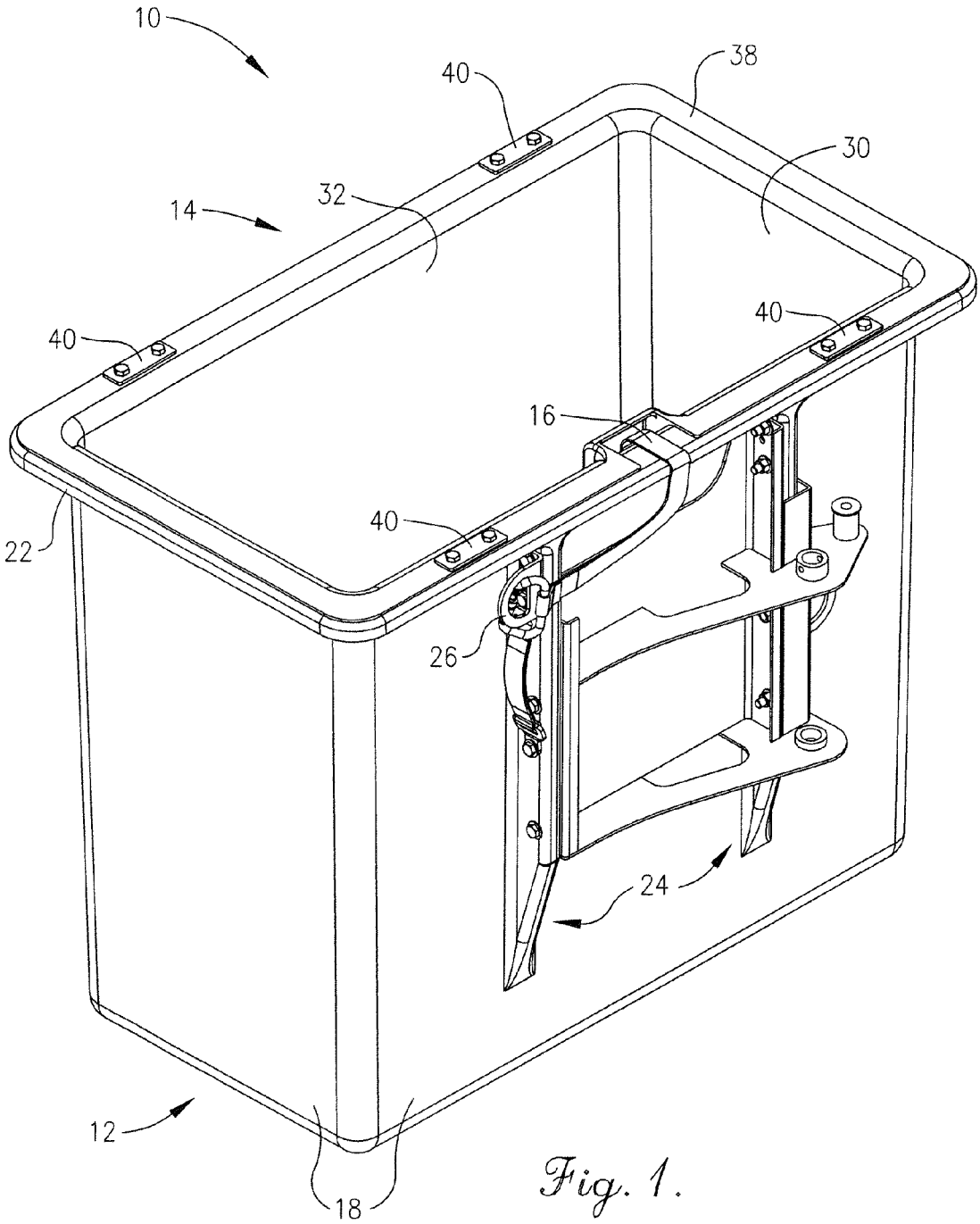
FIG. 1 is a perspective view of a restraint system including a restraint liner and a platform strap, constructed in accordance with various embodiments of the current invention, for restraining a worker to a platform of an aerial device, depicting the restraint liner within the platform and the platform strap coupled to a platform anchor, as seen from above the rear of the platform.
Figure 2:
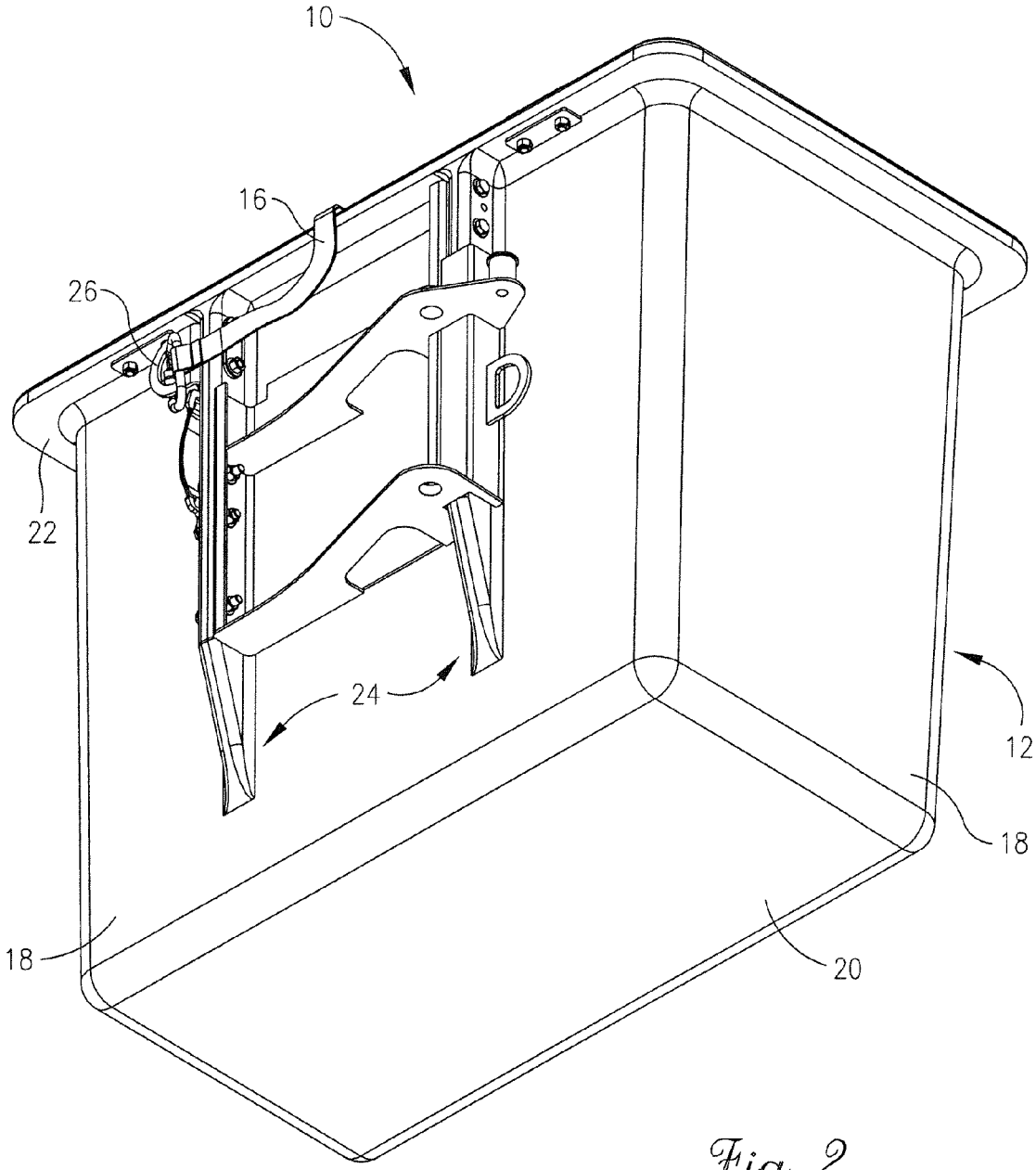
FIG. 2 is a perspective view of the restraint system as seen from below the rear of the platform.
Figure 3:
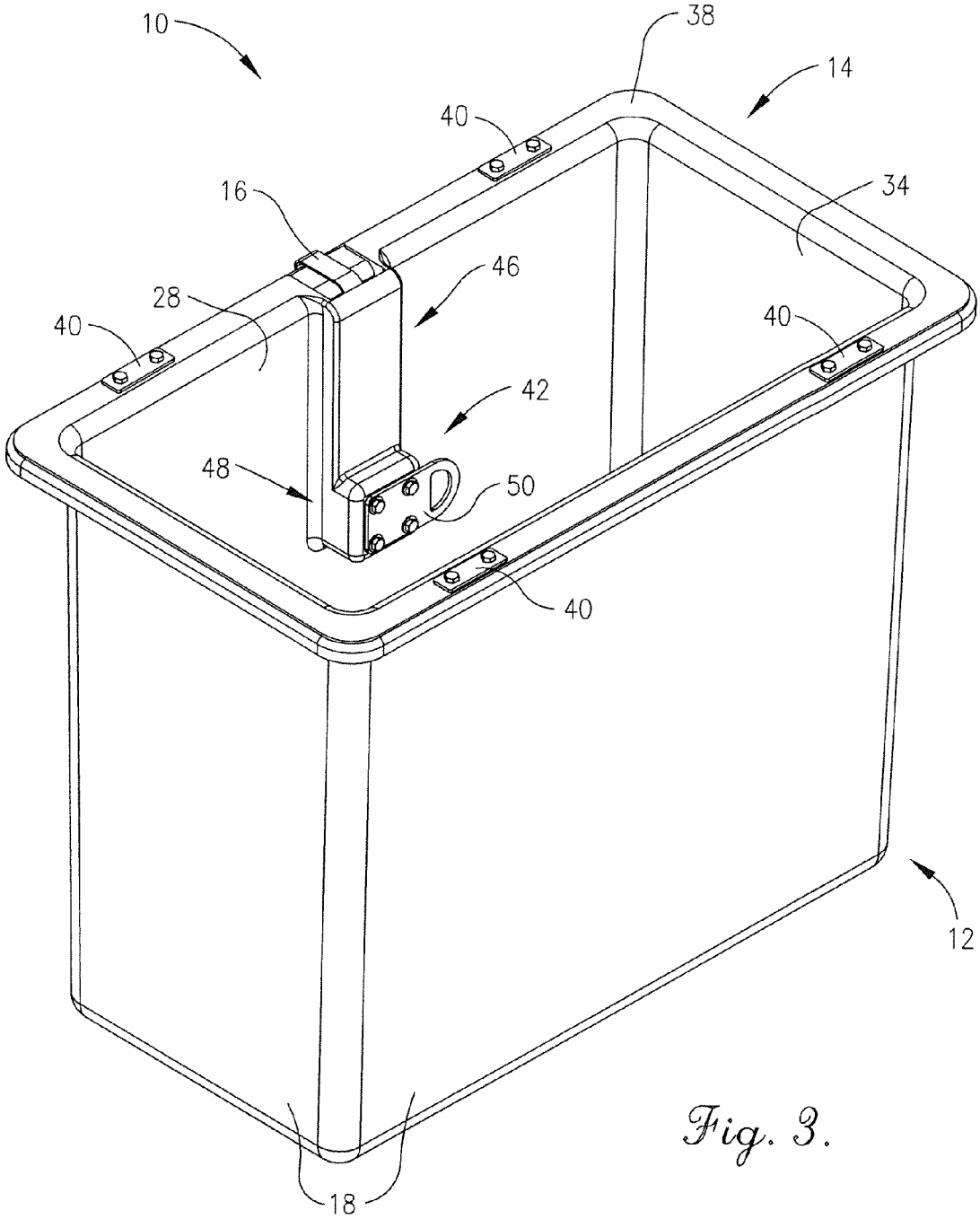
FIG. 3 is a perspective view of the restraint system as seen from above the front of the platform.
Figure 4:
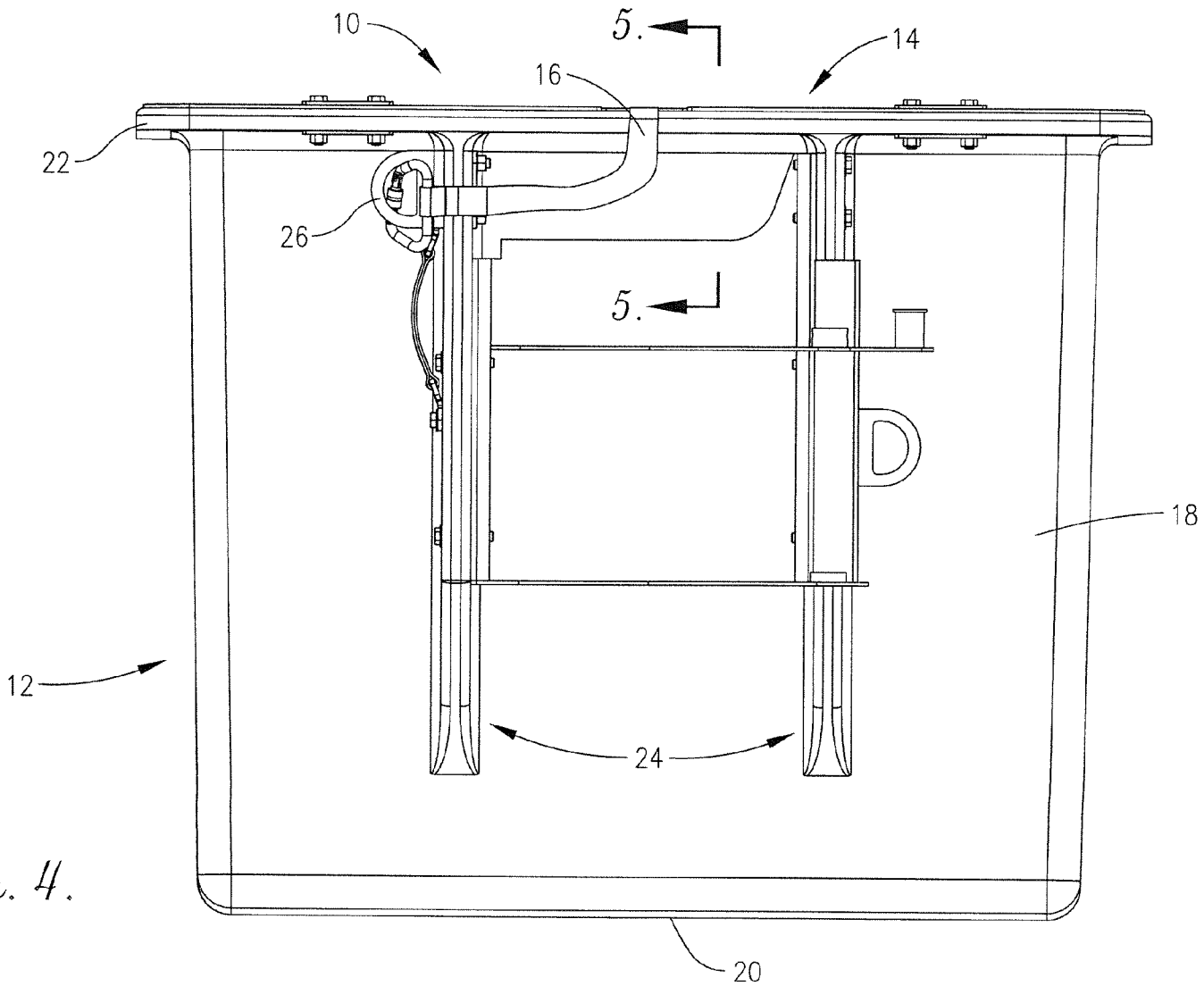
FIG. 4 is a rear elevational view of the restraint system.
Figure 5:
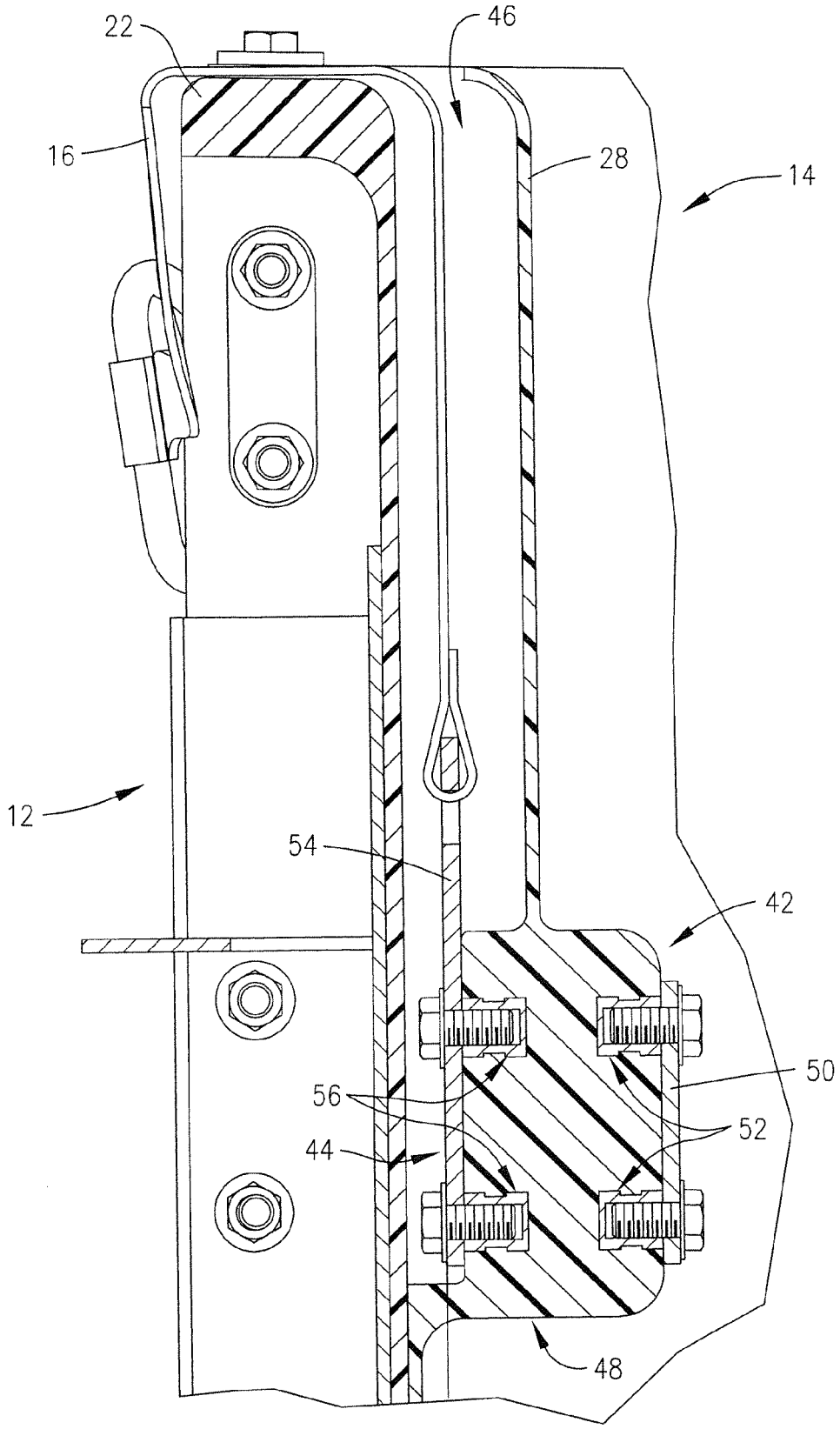
FIG. 5 is a fragmentary sectional view of the restraint system cut along the line "5-5" from FIG. 4.
Figure 6:
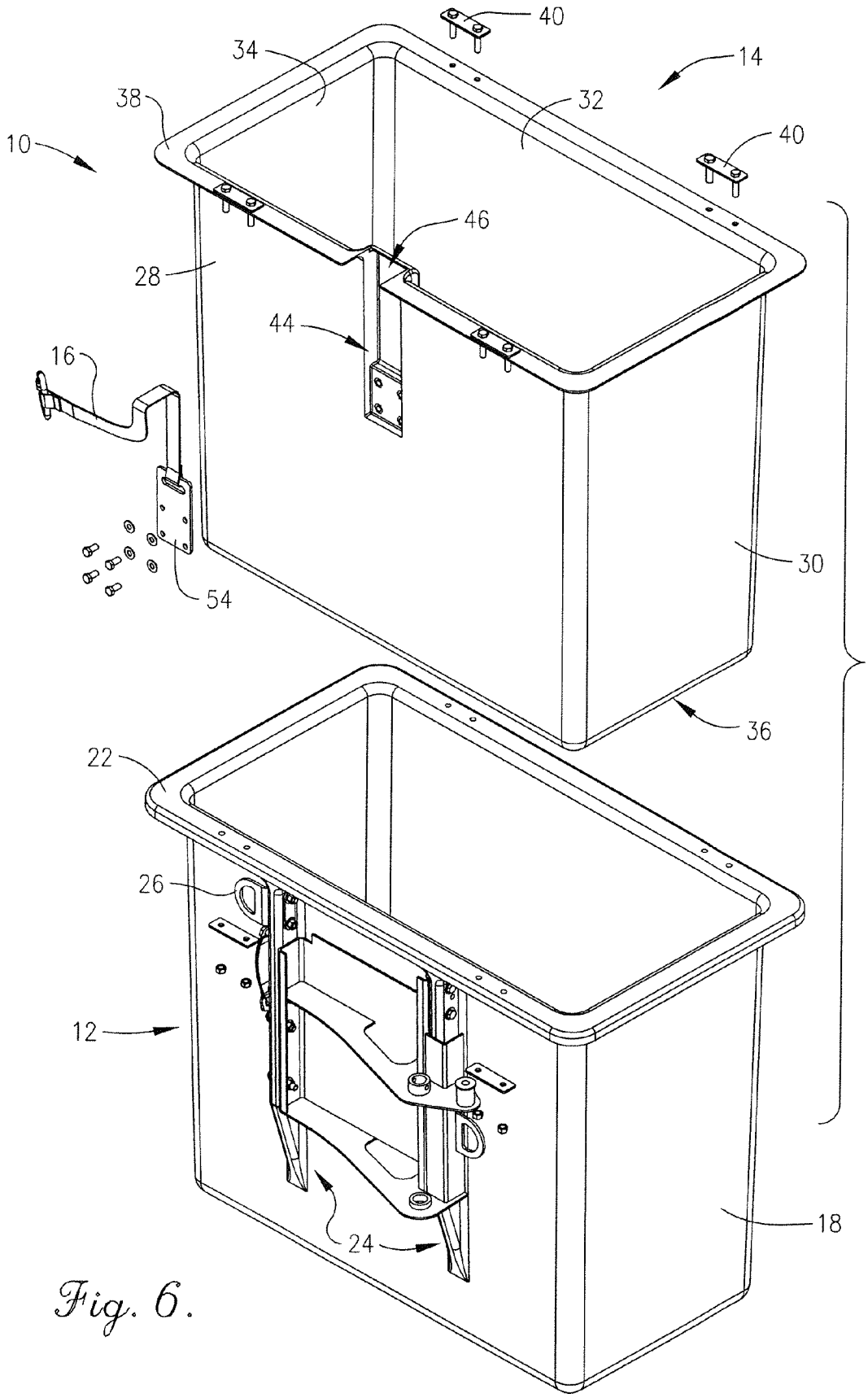
FIG. 6 is a perspective exploded view of the restraint system, depicting the restraint liner separated from the platform and an exterior anchor with an exterior anchor plate coupled to the platform strap, as seen from above the rear of the platform.
Figure 7:
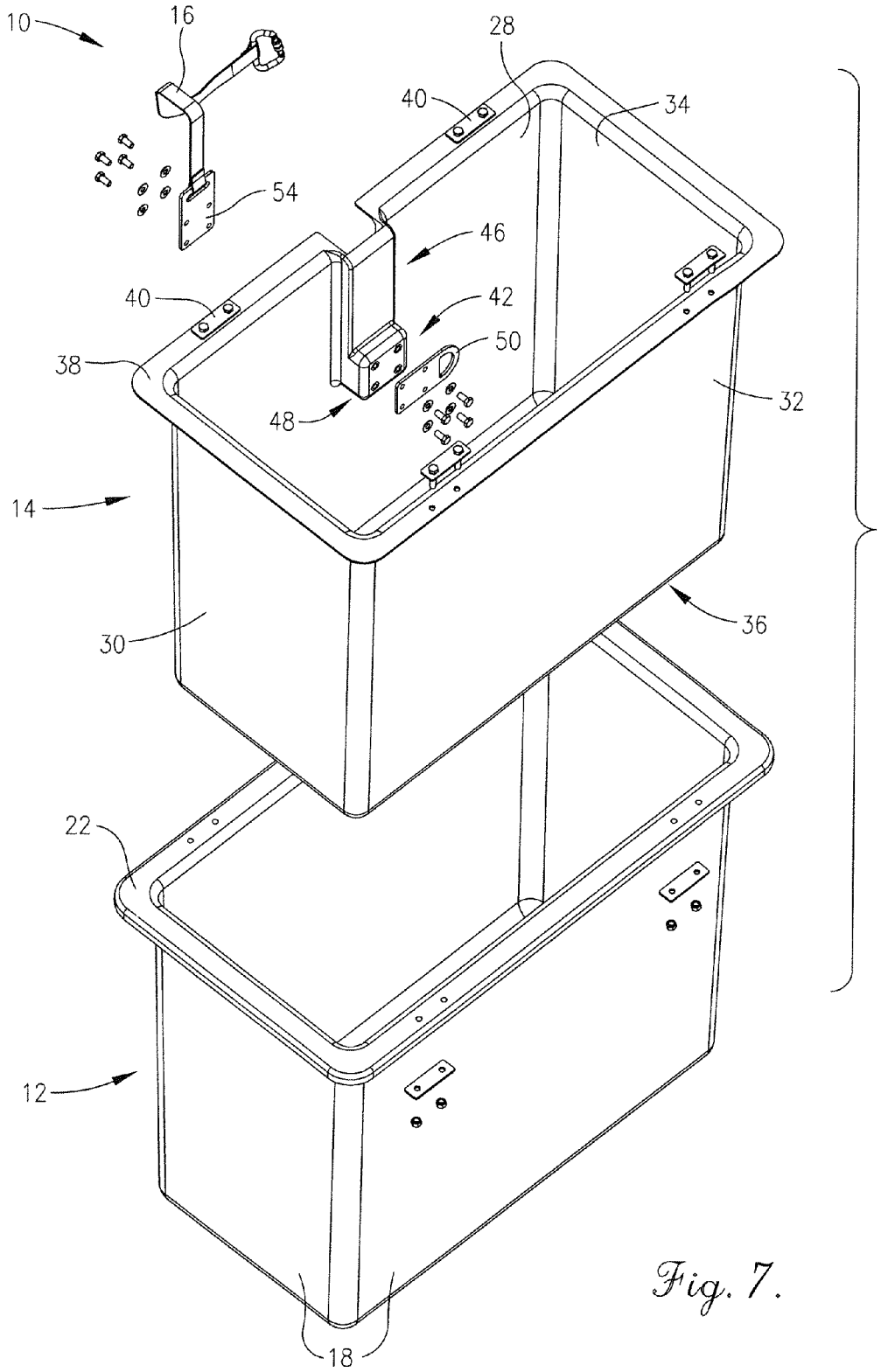
FIG. 7 is a perspective exploded view of the restraint system, depicting the restraint liner separated from the platform, the exterior anchor plate coupled to the platform strap, and an interior anchor with an interior anchor plate, as seen from above the front of the platform.

The restraint liner 14, as best seen in FIGS. 6, 7, and 10, may comprise a first sidewall 28, a second sidewall 30, a third sidewall 32, a fourth sidewall 34, a floor 36, a lip 38, a plurality of lip plates 40, an interior anchor 42, an exterior anchor 44, and a platform strap channel 46. The restraint liner 14 generally fits within the cavity of the platform 12 and thus may have a similar shape. The first, second, third, and fourth sidewalls 28, 30, 32, 34 may be coupled to one anther at opposing edges to form a cylinder with a four-sided cross section having the same (rectangular or square) aspect ratio as the platform 12 in which the restraint liner 14 will be placed. Thus, in various embodiments, one pair of opposing sidewalls, such as the first sidewall 28 and the third sidewall 32, may have a greater width than the other pair of opposing sidewalls, such as the second sidewall 30 and the fourth sidewall 34. The first sidewall 28 may align with the bucket sidewall 18 of the platform 12 that includes the ribs 24 to which the boom tip is connected. The floor 36 may couple to one unconnected end of the sidewalls 28, 30, 32, 34. Generally, the outer surfaces of the floor 36 and the sidewalls 28, 30, 32, 34 of the restraint liner 14 have the same or slightly smaller dimensions as the inner surfaces of the bucket floor 20 and the bucket sidewalls 18.

In other embodiments of the restraint liner 14A, another embodiment of the first sidewall 28A may have a variable thickness that tapers from the interior and exterior anchors 42, 44 to the edges of the first sidewall 28A, as seen in FIGS. 8-10. An exemplary first sidewall 28A may have a frusto-pyramidal shape, wherein the apex of the frustopyramid, or the thickest portion of the first sidewall 28A, is located at the interior and exterior anchors 42, 44, and the base, or the thinnest portion of the first sidewall 28A, is located at the edges.

The lip 38 may couple to the opposing unconnected end of the sidewalls 28, 30, 32, 34 and may form a flange that protrudes outward therefrom. The lip 38 of the restraint liner 14 may be coupled to the bucket lip 22 of the platform 12 using the lip plates 40. The lip 38 may include four pairs of openings that align with similar openings on the bucket lip 22 through which threaded fasteners, such as screws, may be positioned. Each lip plate 40 may include a pair of openings that align with a pair openings on the lip 38. Thus, a lip plate 40 may be placed on the upper or top surface of the lip 38 over a pair of openings therein. Threaded fasteners may be placed through the openings of the lip plate 40, the lip 38, and the bucket lip 22 to couple the restraint liner 14 to the platform 12. Typically, the lip plates 40 and the threaded fasteners are non-conductive. In alternative embodiments, non-conductive washers may be used in place of the lip plates 40.

The restraint liner 14 may be manufactured from non-conductive or insulating materials such as plastics. An exemplary restraint liner 14 may be made from polyethylene pellets that is manufactured in a spun or rotated mold process. The general thickness of the restraint liner 14 may vary, although an exemplary restraint liner 14 may be approximately 0.125 inches thick.

Generally, the platform 12 is not modified to accommodate the restraint liner 14. Thus, any features of the restraint liner 14, such as the interior anchor 42, the exterior anchor 44, or the platform strap channel 46, must be implemented to fit within the interior space of the platform 12.

The interior anchor 42 may be positioned on the interior surface of one of the sidewalls 28, 30, 32, 34, typically the sidewall 1B, such as the first sidewall 28, that aligns with the side of the platform 12 that couples with the boom tip. In various embodiments, the interior anchor 42 may be positioned to align with the exterior anchor 44. The interior anchor 42 may be formed as a mounting block 48 in the first sidewall 28 that extends inward. The interior anchor 42 may include an interior anchor plate 50 coupled to the first sidewall 28 at the mounting block 48. The interior anchor plate 50 may include a loop opening or similar feature to which a restraint that includes a connector may be fastened. The interior anchor plate 50 may be coupled to the first sidewall 28 with threaded fasteners that engage first threaded inserts 52 or sockets embedded in the mounting block 48, best seen in FIGS. 5 and 9. Thus, the first sidewall 28 may have an increased wall thickness in the area of the mounting block 48 to contain the first threaded inserts 52. Having the first threaded inserts 52 contained entirely within the thickness of the first sidewall 28 allows the interior anchor plate 50 to be attached to the mounting block 48 without penetrating the first sidewall 28 or creating an opening from the interior of the first sidewall 28 to the exterior of the first sidewall 28. The interior anchor 42 is generally positioned on the first sidewall 28 below the waist of an average worker.

The exterior anchor 44 may be positioned on the exterior surface of the first sidewall 28, in order to be located in proximity to the platform anchor 26 positioned on one of the ribs 24 of the platform 12. The exterior anchor 44 may be formed from a recess in the first sidewall 28. In typical embodiments, the exterior anchor 44 may be formed in the exterior side of the same mounting block 48 as for the interior anchor 42. In other embodiments, the exterior anchor 44 may be formed in a second recess of the first sidewall 28. The exterior anchor 44 may include an exterior anchor plate 54 coupled to the exterior of the mounting block 48. The exterior anchor plate 54 may include a loop opening or similar feature to which the platform strap 16 may be fastened. The exterior anchor plate 54 may be coupled to the first sidewall 28 with threaded fasteners that engage second threaded inserts 56 embedded in the mounting block 48, best seen in FIGS. 5 and 9. The second threaded inserts 56 may be aligned axially with the first threaded inserts 52. Alternatively, the second threaded inserts 56 may be axially offset from the first threaded inserts 52, wherein the offset is presented to provide sufficient insulating material between the first and second threaded inserts 52, 56 to exceed the insulating rating of the restraint liner 14.

The platform strap channel 46 may include an inward protruding recess of rectangular cross section that extends upward along the first sidewall 28 from the exterior anchor 44. The platform strap channel 46 provides a space, within the confines of the platform 12, for a portion of the platform strap 16 to reside while it is connected from the exterior anchor 44 to the platform anchor 26. The lip 38 of the restraint liner 14 may include a cutout or opening in alignment with the platform strap channel 46 to allow access for the platform strap 16 to pass from the restraint liner 14 over the bucket lip 22 of the platform 12.

The platform strap 16 is generally manufactured from flexible but strengthened material that may withstand a large amount of tension. The platform strap 16 includes a liner end and a platform end. In some embodiments, the liner end may include a releasable connector that couples to the exterior anchor 44 of the restraint liner 14. In other embodiments, the liner end may be non-releasably coupled to the exterior anchor 44. The platform end typically includes a releasable connector that couples to the platform anchor 26. The length of the platform strap 16 is typically very close to the distance from the exterior anchor 44 through the platform strap channel 46 to the platform anchor 26 such that the platform strap 16 is taut with very little slack when the platform strap 16 is coupled to the platform anchor 26. In some embodiments, the platform strap 16 may include a length adjustment structure, such as a buckle or the like, that allows the length of the platform strap 16 to be adjusted to match the distance from the exterior anchor 44 to the platform anchor 26.

The restraint system 10 may be utilized as follows. The restraint liner 14 may be manufactured as discussed above. The interior anchor plate 50 may be attached to the interior anchor 42. If the platform strap 16 is non-releasably coupled to the exterior anchor 44, then the platform strap 16 may be connected to the exterior anchor plate 54 followed by the exterior anchor plate 54 being attached to the exterior anchor 44. If the platform strap 16 is releasably coupled to the exterior anchor 44, then the platform strap 16 is thus connected typically after the exterior anchor plate 54 is attached to the exterior anchor 44. The restraint liner 14 is then placed within the cavity of a platform 12. The first sidewall 28 of the restraint liner 14 may be aligned with the bucket sidewall 18 that includes the ribs 24 to which the boom tip is coupled. The platform end of the platform strap 16 may be coupled to the platform anchor 26. If necessary, the length of the platform strap 16 may be adjusted such that the platform strap 16 is taut.

The restraint system 10 generally operates to restrain the worker within the platform 12, such that the worker is unlikely to fall out of the platform 12. Furthermore, the restraint system 10 generally prevents the worker from leaving the cavity of the platform 12, even voluntarily. In various embodiments, the worker may wear a harness to which one end of a liner strap may connect in the vicinity of the worker's waist. In other embodiments, the liner strap may couple to the worker's belt or a belt loop. The other end of the liner strap may couple to the interior anchor 42, which is generally positioned on the first sidewall 28 below waist level of the average worker. Thus, the liner strap restricts upward motion of the worker while he is in the platform 12. The restraint system 10 also prevents the worker from falling if the platform 12 tips over as the worker is tethered through the liner strap, the interior anchor 42, the exterior anchor 44, and the platform strap 16 to the platform anchor 26.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A platform assembly configured to support a worker during use on an aerial device, the platform assembly comprising:

a restraint liner including:

a first sidewall, a second sidewall, wherein the second sidewall is adjacent to the first sidewall, a third sidewall, wherein the third sidewall is adjacent to the second sidewall, and the third sidewall is opposite the first sidewall, a fourth sidewall, wherein the fourth sidewall is adjacent to the third sidewall, the fourth sidewall is opposite the second sidewall, and the fourth sidewall is adjacent to the first sidewall, and a floor coupled to a first end of the first, second, third and fourth sidewalls of the restraint liner; and a platform configured to be coupled to a boom tip of the aerial device, the platform including:

a first sidewall, a second sidewall, wherein the second sidewall of the platform is adjacent to the first sidewall of the platform, a third sidewall, wherein the third sidewall of the platform is adjacent to the second sidewall of the platform, and the third sidewall of the platform is opposite the first sidewall of the platform, a fourth sidewall, wherein the fourth sidewall of the platform is adjacent to the third sidewall of the platform, the fourth sidewall of the platform is opposite the second sidewall of the platform, and the fourth sidewall of the platform is adjacent to the first sidewall of the platform, and a floor coupled to a first end of the first, second, third and fourth sidewalls of the platform, wherein the restraint liner is inserted in the platform such that the first, second, third, and fourth sidewalls of the restraint liner are generally respectively aligned with the first, second, third, and fourth sidewalls of the platform; and an interior anchor positioned on an interior surface of the first sidewall of the restraint liner, the interior anchor configured to couple to a liner strap coupled to the worker to arrest the worker during a fall; and an exterior anchor positioned on an exterior surface of the first sidewall of the restraint liner, the exterior anchor coupled to a platform strap coupled to the platform to couple the restraint liner and the platform to each other; and a platform strap channel located between the first sidewall of the platform and the first sidewall of the restraint liner and extending upward from the exterior anchor and operable to retain a portion of the platform strap.

2. The platform assembly of claim 1, further including a lip extending from a second end of the sidewalls of the restraint liner and including a cutout that aligns with the platform strap channel and allows the platform strap to pass through the lip and into the platform strap channel.

3. The platform assembly of claim 1, further comprising a mounting block on the first sidewall of the restraint liner that extends toward an interior of the restraint liner to present an increased thickness at the first sidewall of the restraint liner.

4. The platform assembly of claim 3, wherein the interior anchor includes an interior anchor plate coupled to the first sidewall of the restraint liner at the mounting block, and the mounting block includes sockets embedded in the increased thickness at the first sidewall of the restraint liner that are operable to receive fasteners to couple the interior anchor plate to the first sidewall of the restraint liner.

5. The platform assembly of claim 3, wherein the exterior anchor includes an exterior anchor plate coupled to the first sidewall of the restraint liner at the mounting block, and the mounting block includes sockets embedded in the increased thickness at the first sidewall of the restraint liner that are operable to receive fasteners to couple the exterior anchor plate to the first sidewall of the restraint liner.

6. The platform assembly of claim 1, wherein the first sidewall of the restraint liner has a variable thickness such that the first sidewall of the restraint liner has a first thickness at the first end of the first sidewall of the restraint liner or a second end of the first sidewall of the restraint liner, and the first sidewall of the restraint liner has a second thickness at the platform strap channel, wherein the first thickness is less than the second thickness.

7. The platform assembly of claim 1, wherein the restraint liner is insulated.

8. The platform assembly of claim 1, wherein the platform strap channel protrudes inward from the first sidewall of the platform towards the third sidewall of the restraint liner and protrudes away from the exterior surface of the first sidewall of the restraint liner.

9. The platform assembly of claim 1, wherein the platform strap is releasably coupled to the exterior anchor such that the restraint liner is coupled to the platform.

10. The platform assembly of claim 1, wherein the platform strap is non-releasably coupled to the exterior anchor.

* * * * *